US005144888A

United States Patent [19]

Heine et al.

[11] Patent Number: 5,144,888

[45] Date of Patent: Sep. 8, 1992

[54] COMBINED TABLE COMPRISING A PLURALITY OF INDIVIDUAL TABLE SURFACES

[75] Inventors: Klaus A. Heine, Frankfurt; Uwe Fischer, Offenbach, both of Fed. Rep. of Germany

[73] Assignee: Protoned B.V., Amsterdam, Netherlands

[21] Appl. No.: 761,672

[22] Filed: Sep. 18, 1991

[30] Foreign Application Priority Data

Oct. 10, 1990 [CH] Switzerland ..... 3266/90

[51] Int. Cl.[5] ..... A47B 57/00

[52] U.S. Cl. ..... 108/64; 108/89

[58] Field of Search ..... 108/64, 65, 69, 76, 108/84, 91; 403/326, 367

[56] References Cited

U.S. PATENT DOCUMENTS

| | | | |
|---|---|---|---|
| 1,009,902 | 11/1911 | Hanson | 108/89 |
| 4,165,908 | 8/1979 | Cooper et al. | 108/64 X |
| 4,409,906 | 10/1983 | Alneng | 108/64 X |
| 4,591,289 | 5/1986 | Vickers et al. | 108/64 X |

FOREIGN PATENT DOCUMENTS

| | | | |
|---|---|---|---|
| 400833 | 4/1969 | Australia | 108/64 |
| 550169 | 12/1957 | Canada | 108/64 |
| 150692 | 9/1981 | Fed. Rep. of Germany | 108/64 |
| 772578 | 11/1934 | France | 108/89 |
| 2100121 | 12/1982 | United Kingdom | 108/64 |

OTHER PUBLICATIONS

*IBM Technical Disclosure Bulletin*, Hagen, "Conference Classroom Desk Table Design for Multiple Arrangement", Feb. 1974.

*Primary Examiner*—Jose V. Chen

*Attorney, Agent, or Firm*—Ralph W. Selitto, Jr.

[57] ABSTRACT

A combined table includes a plurality of individual table surfaces interconnected to form a multi-unit table in which additional table and/or table top elements are coupled to a main table by a plurality of coupling members. Each of the coupling members includes a snap-type fastener and extends from one mounting bar positioned beneath the main table to another mounting bar positioned beneath the additional table and/or table top element.

9 Claims, 5 Drawing Sheets

Fig. 8
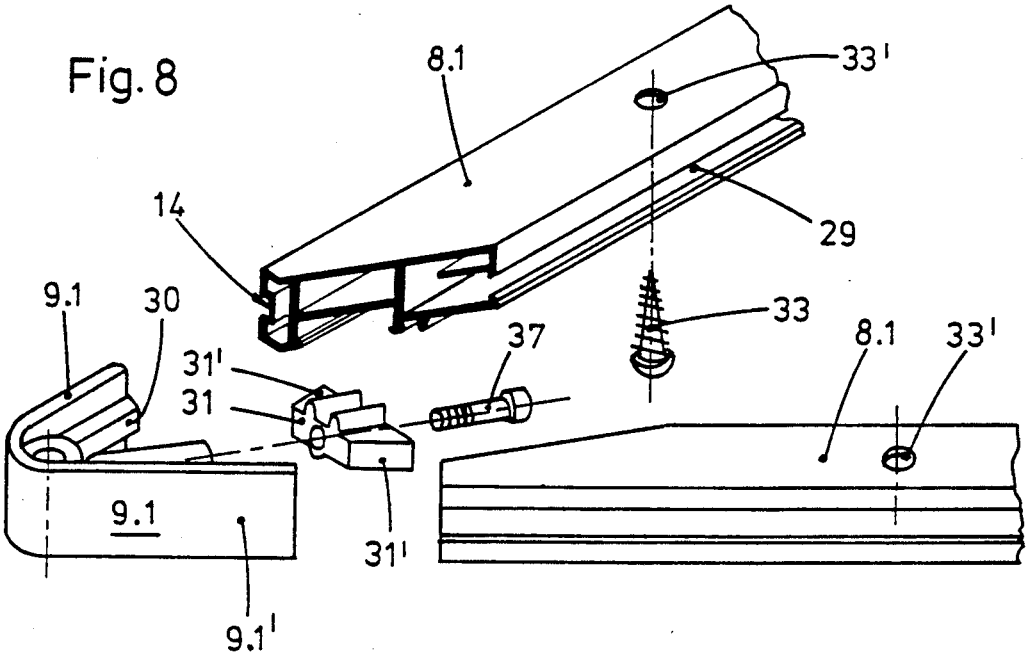
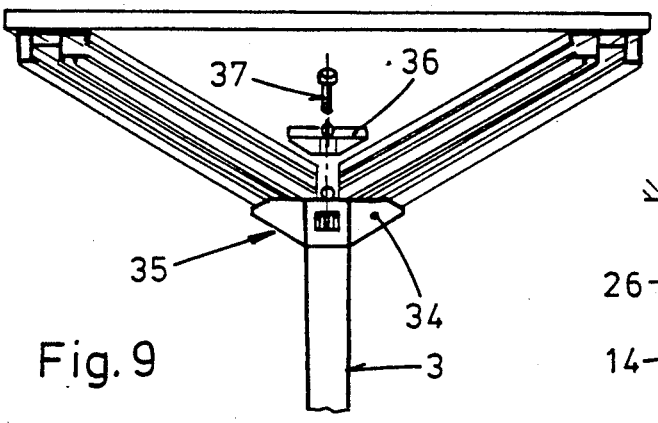
Fig. 9
Fig. 7
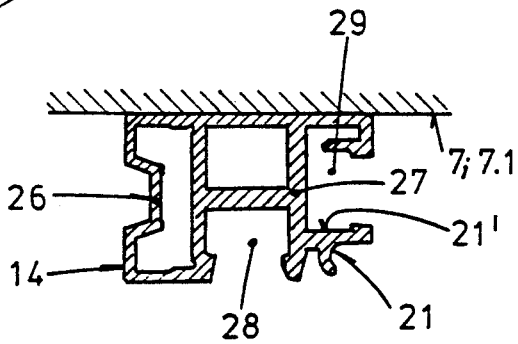
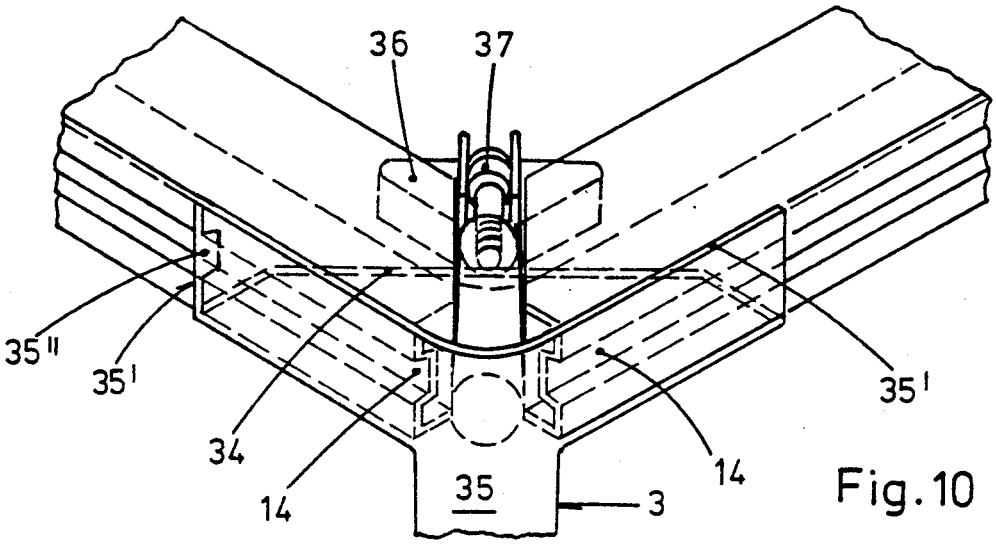
Fig. 10

COMBINED TABLE COMPRISING A PLURALITY OF INDIVIDUAL TABLE SURFACES

The invention relates to a combined table comprising a plurality of individual table surfaces according to the preamble of patent claim 1, particularly to a multi-unit table in which additional table and/or table top elements are coupled to one or more side edges of a main table, wherein support portions, provided with snap means on coupling members and held on a first sectional bar on the underside of a base, for a second sectional rail on the additional table element are detachably connected to the first sectional bar.

It is known for so-called joined tables to be detachably joined together by means of claw members which are fastened to the table top and which project beyond the side edges of the latter. Individual tables constructed in this manner preferably permit the formation of linear table groupings because the claw members can be affixed practically only on the side edges remote from the user side. Plate or bar connections which are detachably fastened on the underside of the table, for example by means of screw connections, which also enable tables to be joined at an angle, are also known, although their construction is complicated. In addition, there is the danger that screw elements and connecting members can easily be mislaid unless they are necessarily to be refastened to the respective table element upon disassembly.

The object of the invention is thus that of providing a table which is composed of a plurality of individual tables and in which the individual tables are joined fast together by conveniently insertable snap members and can easily be detached when the table arrangement has to be changed. It is important that those side edges of all the individual tables used which are not utilized to make up the table assembly are free from projecting coupling members and that the arrangement of the table top surface is freely selectable within the scope of an arrangement principle.

The advantage of a combined table according to the invention is obvious, namely that table top surfaces of different contour shapes can be formed quickly and reliably to form practically any table configuration. Equally obvious are the advantages for the detachment and storage of the table elements, for which purpose above all the legless table top elements can be stacked in a space-saving manner.

The solution according to the invention to this problem is defined in patent claim 1. Embodiments thereof are shown in the dependent claims.

Figure 1A:
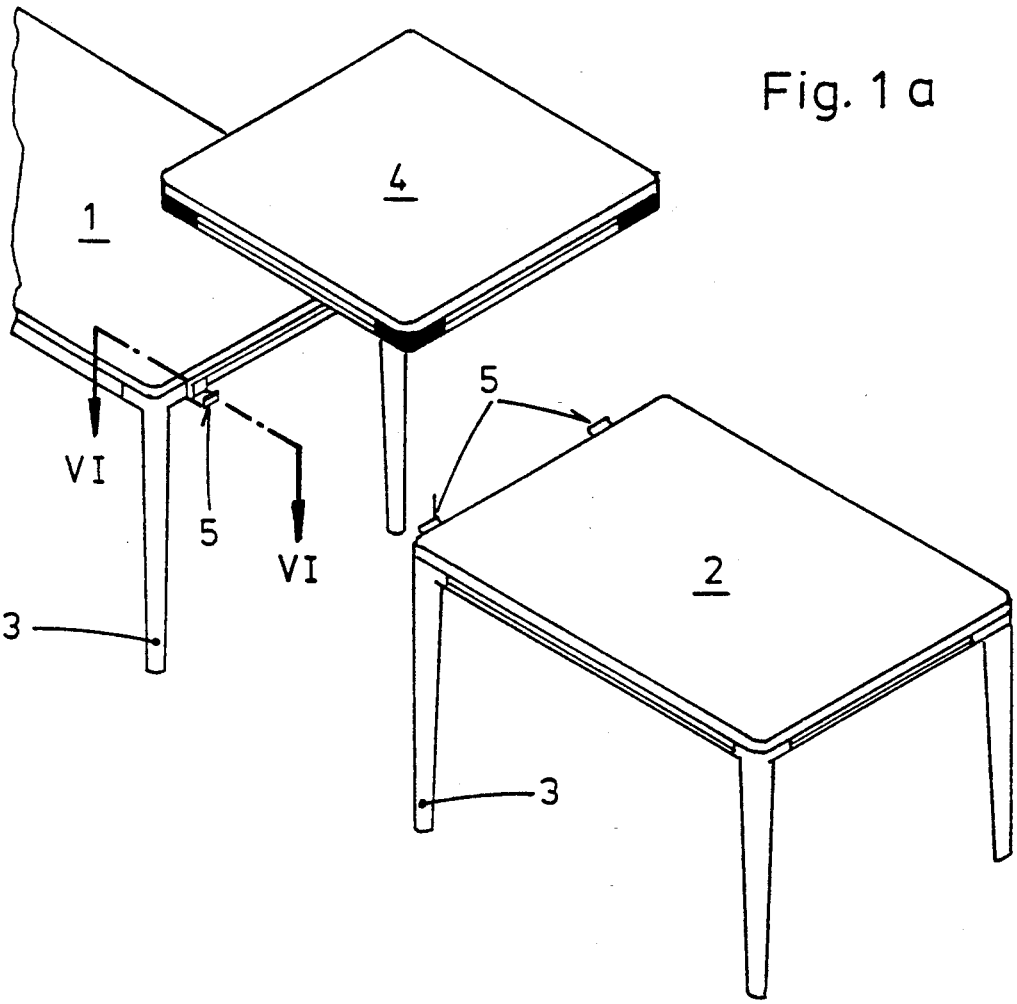
Figure 1B:
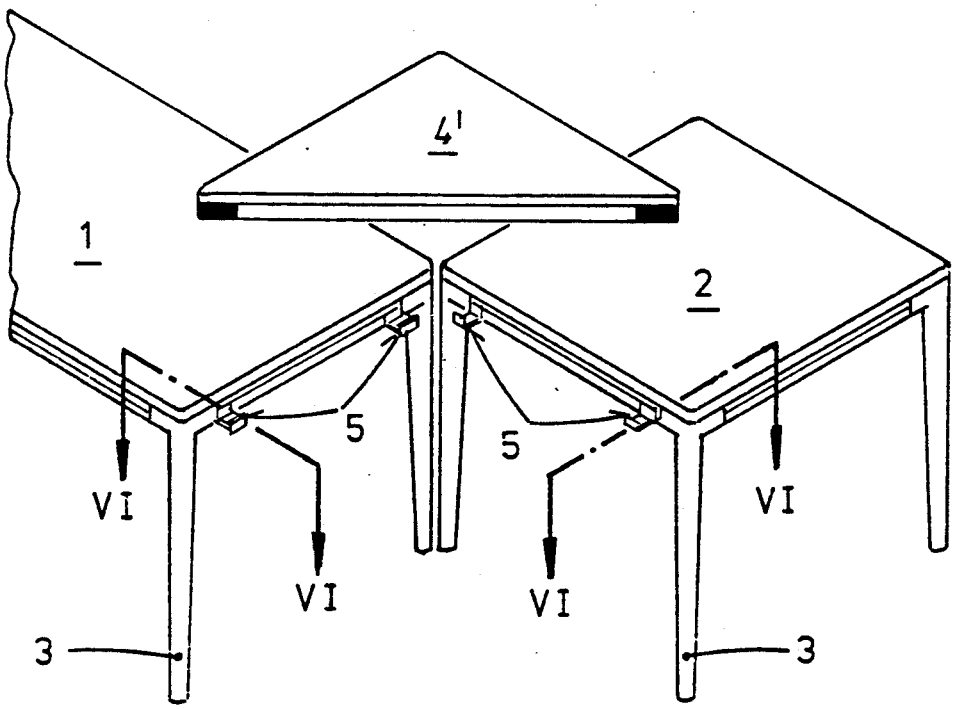
Figure 2A:
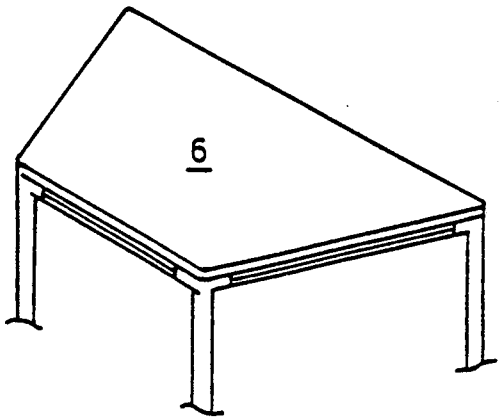
Figure 2B:
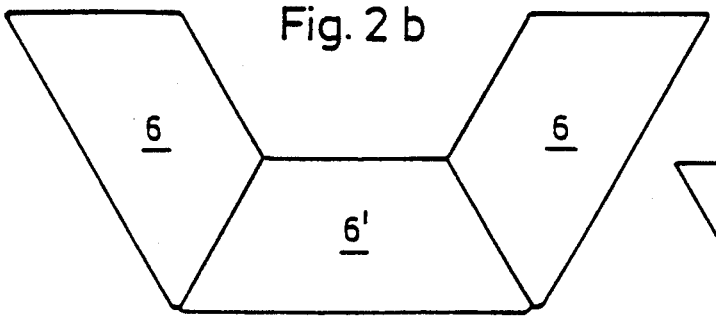
Figure 2C:
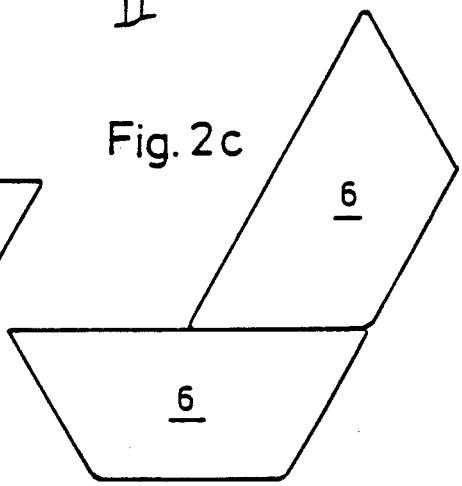
Figure 3A:
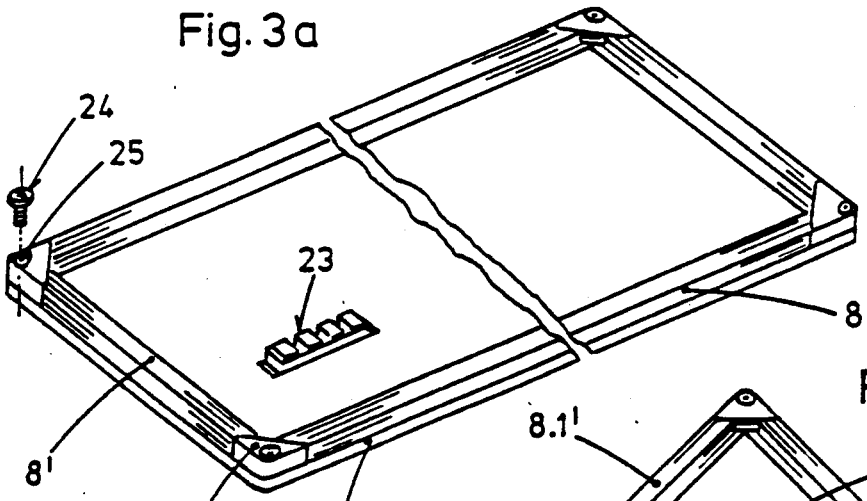
Figure 3B:
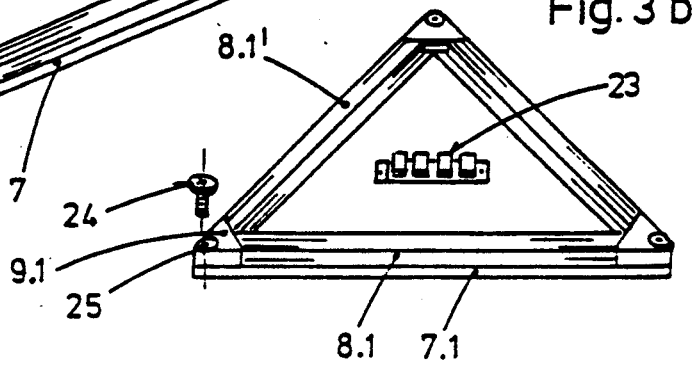
Figure 4A:
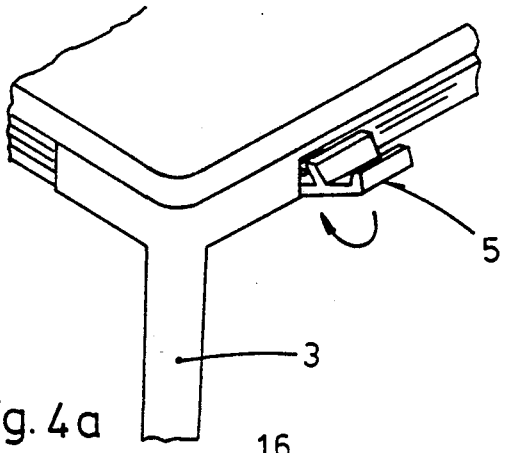
Figure 4B:
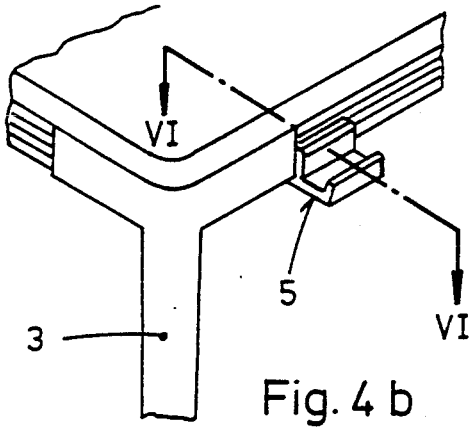
Figure 5:
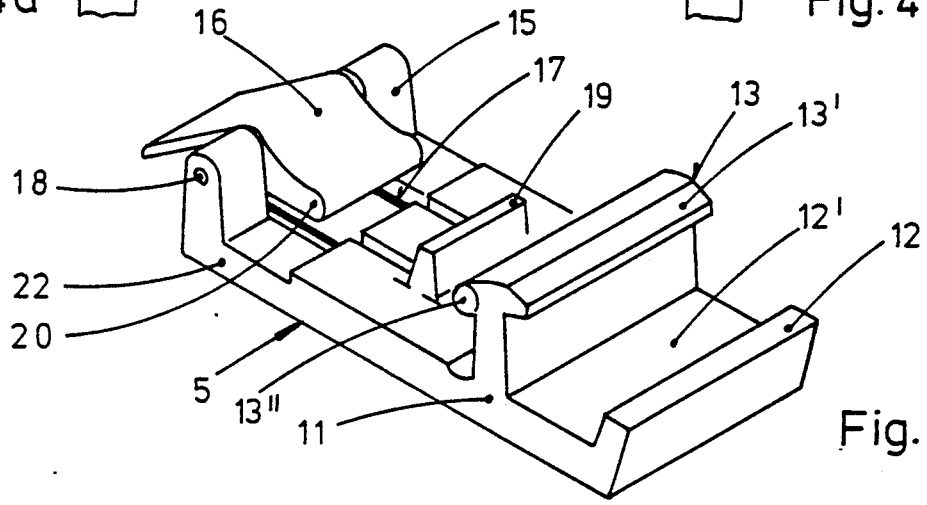
Figure 6A:
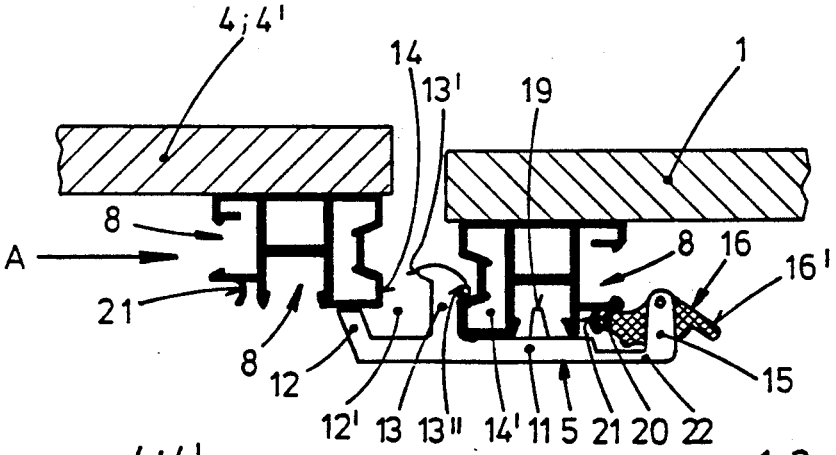
Figure 6B:
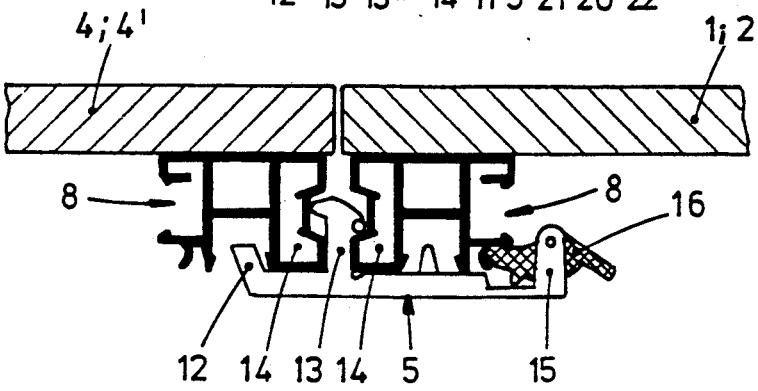
Figure 11:
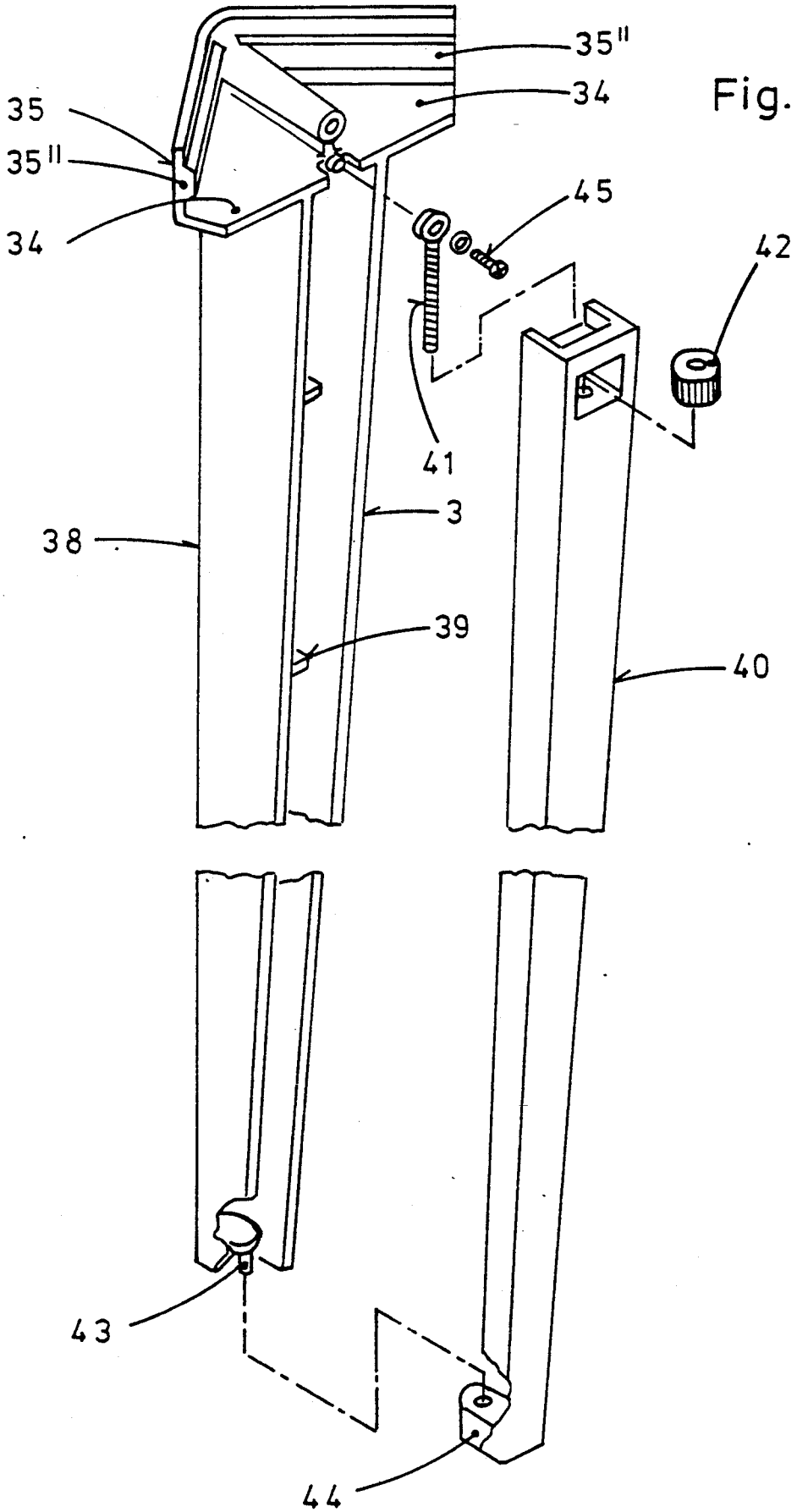

Examplary embodiments and details of the object of the invention are described below with reference to the drawings, in which:

FIGS. 1*a* and 1*b* show examples of surface contour arrangements,

FIGS. 2*a* to 2*c* show examples of arrangement with table tops of trapezoidal shape, FIGS. 3*a* 3*b* are views of the undersides of typical table tops without table legs, FIGS. 4*a* and 4*b* illustrate the attachment of a coupling member on a longitudinal side of a table top, FIG. 5 is a view in perspective of one embodiment of a coupling member, FIGS. 6*a* and 6*b* show two steps in the coupling of an additional table top to a first or main table top, in section on the lines VI—VI in FIGS. 1*a*, 1*b* and 4*b*, FIG. 7 a cross-section of a table edge profile, FIG. 8 shows elements for forming table edges at an (acute-angled) table top corner without a supporting foot, in an exploded view, FIG. 9 shows a table corner viewed from below, with a table leg and with the clamp members shown in an exploded view, FIG. 10 shows similarly to FIG. 9 a table corner with a table leg, viewed from above, and FIG. 11 shows a table leg of the type illustrated in FIGS. 9 and 10, viewed from "inside", with the table height adjustment components shown in an exploded view.

In FIGS. 1*a* and 1*b* are shown first examples of arrangements of table combinations formed from individual table top surfaces with and without table legs fastened to them. Starting from a main or basic table 1, additional table elements 2 having their own legs 3 and legless table top elements 4, 4' are added, either (a) in a rectilinear arrangement or (b) in an angular arrangement, said elements 4, 4' being of square or rectangular shape in case (a) but of triangular shape in case (b). The legless table top elements 4, 4' are mounted on coupling members 5, as will be explained in detail later on.

Further examples of table arrangements are shown in FIGS. 2*a* to 2*c*, where by joining trapezoidal individual tables or individual table tops 6, 6' angular table combinations of the most diverse types are assembled. There are practically no limitations to arrangements of individual table tops to form table surfaces having rectilinear longitudinal sides, so that the examples can be extended as desired.

FIGS. 3*a* and 3*b* show legless table tops of two typical contour shapes, wherein sectional mounting bars 8, 8'; 8.1, 8.1', expediently set back inwards from the edge, are fastened on the underside of a shape-defining base 7, 7.1 of, for example, wood core plywood, chipboard, plywood, plastic material or the like. The corner regions of the sectional bars 8. . . 8.1' are provided with cover caps 9, 9.1, in order to obtain a pleasing appearance. These cover caps 9, 9.1 are affixed flush with the edges to the base 7, 7.1. In FIG. 8 the fastening of a cover cap 2.1 at the (acute-angled) ends cut to size of two sectional bars 8.1 is shown. A detailed description of the cover caps will be given later on, when the details of the coupling members 5 and the functions of the profiling of the sectional bars have been understood.

In order to avoid damage during stacking and to facilitate the handling of stacked table tops, the cover caps 9, 9' can be provided with spacer pins 24. The latter can be screwed into threaded holes 25 in the corner regions of the caps.

FIGS. 4*a* and 4*b* show how a coupling member 5 shaped as shown in FIG. 5 is attached to a sectional bar having the cross-section shown in FIG. 7 and clamped fast thereon. The respective cross-sectional shapes are shown in FIGS. 6*a* and 6*b*.

The coupling member shown in FIG. 5 carries at one end of a base 11 a catch lug 12 which, in conjunction with the top hook 13' of a clamp rib 13, forms a catch region 12' for a fitting zone 14 on the sectional bar of an additional table top element 4, 4' which is to be engaged therein. The bottom hook 13'' of the clamp rib 13 is intended as a stop for the fitting zone 14' on the sectional bar of the main table top, said zone 14' coming to lie in a mirror-image arrangement. At the other end of the base 11 is provided a supporting bearing 15 for a clamp rocker 16 which is movable about a shaft 18 against the pre-stress of a spring 17. Together with a portion 22 of the base 11 where the thickness is reduced, the mounting in this manner of the spring-loaded rocker 16 forms a clamping region which, being made of plastic material, has inherent resilience and is therefore very suitable for the previously mentioned snap engagement. About halfway between the clamp rib 13 and the supporting bearing 15 is disposed a centering rib 19, which facilitates the location of the clamp region during the attachment of the coupling member 5 to the fitting zone 14' of the sectional bar on a main table.

By applying the coupling member 5 to the fitting zone 14' in an inwardly and downwardly inclined position, referring to FIGS. 4 and 6*a*, with the bottom hook 13'' forwards, and then swivelling it inwards in the clockwise direction under the sectional bar, the coupling member 5 will assume the position shown there. A bead 20 formed on the inner end of the clamp rocker 16 thus engages in a rounded channel 21 in the sectional bar. The spring 17 on the coupling member 5, in conjunction with the clamp rocker 16, thus clamps said coupling member against the sectional bar in such a manner that the coupling member 5 is held fast on the underside of the table. When two such coupling members 5 have been attached to the corresponding sectional bars, the support for an additional table top element 4, 4' is ready.

As shown in FIG. 6*a*, said table top element can now be added to the main tables by pushing it towards the main table 1 in the direction of the arrow A and inserting the fitting zone 14 into the catch region 12' on the coupling member 5. The situation shown in FIG. 6*b* is thus obtained in the abutting regions of the respective main tables.

For the dismantling of a table combination, after the table top elements 4, 4' have been lifted out of the catch regions 12' of the coupling members 5, the latter are in turn detached from the sectional bar by pressing down the clamp rocker operating lever 16' and are pulled in an inclined position out of engagement with the sectional bar. In order to prevent the coupling members from being lost, the undersides of legless table tops may be provided, as shown in FIG. 3, with so-called storage bands 23 having longitudinal profiling, for example, similar to that of the sectional bars, in order to enable unused coupling members to be clipped to them.

The cross-section of the sectional bars 8, 8.1' which is shown in FIG. 7 is to be viewed with the top contact surface facing the underside of the base 7, 7.1. On the left of the figure is the fitting zone 14 with a wall portion 26 set back inwards to receive in each case one of the hooks 13' or 13'' depending on the position of the respective sectional bar on the table top. The bottom portion of the fitting zone 14 in the assembled table combination lies either in the catch region 12' or between the clamp rib 13 and the centering rib 19 on the coupling member 5. On the bearer 27 of the rounded channel 21 lying opposite the fitting zone 14 is formed a tongue 21' on which the channel is formed, said bearer having the same height dimension as the fitting zone 14. The channel 21 serves, as already mentioned, to receive the bead 20 which is formed on the clamp rocker 16 of the coupling member 5 and which is swivelled inwards when said coupling member is attached to the sectional bar. Another channel 28, which is open at the underside of the profile, is provided to receive the centering rib 19 provided on the coupling member 5, and serving for precentering during attachment of the coupling member to the sectional bar. A third channel 29 on the same side as the rounded channel 21 can serve to receive locking members on corner cover caps 9, 9.1, as can be seen in FIG. 8.

FIG. 8 shows the elements for forming an acute-angled table edge corner on a (legless) table top. The construction of a rectangular or obtuse-angled table edge corner is correspondingly similar. The ends of the sectional bars are cut to correspond to the angle of abutment, in such a manner that a guide rib 30 on the inside of the cap legs 9.1' engages as far as possible into the fitting zones 14 of the neighboring sectional bars 8.1. The two sectional bar ends are additionally screwed to the cover cap 9.1 (screw 37) by means of a locking member 31, from which laterally projecting wing parts 31' engage in their third channel 29. A screw 33 corresponding to a fastening hole 33' indicates how the sectional bars are mounted on a base (not shown) lying above them.

In FIGS. 9 and 10 is shown the connection of a table leg 3 by means of a mounting arrangement 35 in the corner region of two sectional bars disposed on the underside of a table top. The table leg 3 is provided at its top end with a supporting plate 34 which engages under the sectional bars and on which edge legs 35' are formed, as in the case of the cover caps 9, 9.1. Each edge leg 35' is provided with a guide rib 35'' similar to the guide rib 30 on the cover cap 9.1, and engaging in a fitting zone 14 on the sectional bar. A table leg anchorage shaped similarly to the cover cap anchorage (FIG. 8) contains a locking member 36 which is shown schematically in FIGS. 9 and 10 and which is supported on the inside of the sectional bar ends and tightened against the table leg mounting 35 by means of the screw 37.

Shown in FIG. 11 is a table leg 3, which is provided at the top with a table leg anchorage 35 of the kind shown in FIGS. 9 and 10. On said table leg is formed a bar portion 38 which is U-shaped in cross-section and which is strengthened by cross-stiffeners 39. In the U-shaped bar portion 38, which is preferably made of metal, is provided a vertically adjustable insert part 40, for example of plastic material, which is displaceable relative to the bar portion 38 by means of a spindle arrangement. The insert part 40 is mounted for longitudinal movement in the bar portion 38 by means of the spindle arrangement consisting of a spindle 41, which is suspended at the top end of the bar portion 38, and of a rotatably fastened knurled nut 42, together with a pin guide consisting of a centering pin 43 and a foot part 44 at the bottom end. The spindle 41, guided in the insert part 40 together with the knurled nut 42, is connected by a screw 45 to the bar portion 38 in such a manner that a table leg in the form of a self-contained unit is produced. The pin guide 43/44 is of very sturdy construction, corresponding to the customary stressing.

The height adjustment means shown, applied to at least two of the four table legs of main tables, is advisable, because the clamping engagement of the coupling member can thereby be optimized. At the same time it is possible for the surface of an entire table combination to be aligned to a single plane in a simple manner without components not forming part of the table being required.

We claim:

1. In a combined table comprising a plurality of individual table surfaces having rectilinear side edges, at least a pair of said table surfaces being provided with vertically adjustable legs, and at least a pair of coupling members for connecting one of said pair of table surfaces to an adjacent table surface, each of said coupling members having snap means for detachably connecting each of said coupling members to a first sectional bar mounted in an underside of said one table surface and catch means for detachably connecting each of said coupling members to a second sectional bar mounted on an underside of said adjacent table surface, the improvement wherein each end of said first sectional bar is held in first corner cover means mounted on said underside of said one table surface flush with adjacent side edges thereof and each end of said second sectional bar is held in second corner cover means mounted on said underside of said adjacent table surface flush with adjacent side edges thereof; wherein each of said first and second sectional bars has an outside edge provided with a fitting zone sized and shaped so as to be engageable with an intermediate portion of said coupling members and an inside edge provided with a first channel sized and shaped so as to be engageable with said snap means of said coupling members and a second channel sized and shaped so as to be engageable with wedge locking means for fastening said first and second sectional bars to said first and second corner cover means, respectively; and wherein each of said vertically adjustable legs contains an insert part which is adjustable by means of a spindle and a knurled nut and which includes a foot part guided by a centering pin.

2. A combined table as claimed in claim 1, wherein said intermediate portion of said coupling members includes a clamp rib which divides each of said coupling members into a clamp portion containing said snap means and a support portion containing said catch means.

3. A combined table as claimed in claim 2, wherein said clamp portion also includes a bottom hook extending outwardly from said clamp rib in a first direction which is toward said snap means and wherein said support portion includes a catch lug and a top hook extending outwardly from said clamp rib in a second direction which is opposite to said first direction and which is toward said catch lug.

4. A combined table as claimed in claim 1, wherein said snap means includes a spring-loaded rocker which has a bead sized and shaped so as to be engageable with said first channel of said first and second sectional bars and which is pivotally mounted on a resilient portion of said coupling members.

5. A combined table as claimed in claim 4, wherein said fitting zone of said first and second sectional bars has a wall portion forming an indentation which is sized and shaped so as to receive said bottom hook and said top hook of said clamp rib.

6. A combined table as claimed in claim 1, wherein at least one of said pair of table surfaces is provided with four vertically adjustable table legs.

7. A combined table as claimed in claim 1, wherein said adjacent table surface is provided with vertically adjustable legs.

8. A combined table as claimed in claim 1, wherein said adjacent table surface is legless.

9. A combined table as claimed in claim 8, wherein said adjacent table surface is connected between said one table surface and the other table surface of said pair of table surfaces.

* * * * *